United States Patent [19]

Jury

[11] Patent Number: 4,581,045

[45] Date of Patent: Apr. 8, 1986

[54] GAS DISTRIBUTING DEVICE

[75] Inventor: Egon Jury, Egelsbach, Fed. Rep. of Germany

[73] Assignee: Metallgesellschaft Aktiengesellschaft, Frankfurt am Main, Fed. Rep. of Germany

[21] Appl. No.: 641,437

[22] Filed: Aug. 16, 1984

[30] Foreign Application Priority Data

Aug. 18, 1983 [DE] Fed. Rep. of Germany ..... 3329849

[51] Int. Cl.[4] ..... B03C 3/36; F24F 7/00; F24F 13/00

[52] U.S. Cl. ..... 55/129; 98/40.01; 55/419; 137/599; 138/42; 138/44

[58] Field of Search ..... 55/128, 129, 418, 419; 98/40.01, 40.10; 137/599; 138/42, 44; 209/154, 313, 395, 399, 403; D23/112-116

[56] References Cited

U.S. PATENT DOCUMENTS

| | | | |
|---|---|---|---|
| 721,875 | 3/1903 | Farnsworth | 209/399 X |
| 2,519,162 | 8/1950 | Tucker | 209/399 |
| 3,475,869 | 11/1969 | Jahn | 98/40.10 |
| 3,716,027 | 2/1973 | Vickstrom et al. | 52/588 X |
| 3,792,774 | 2/1974 | Rosenblum | 209/403 X |
| 3,892,546 | 7/1975 | Grisell | 55/129 |
| 4,207,083 | 6/1980 | Gelhaar et al. | 55/129 |

FOREIGN PATENT DOCUMENTS

| | | | |
|---|---|---|---|
| 868548 | 2/1953 | Fed. Rep. of Germany | 209/399 |
| 500431 | 5/1976 | U.S.S.R. | 98/40.14 |

*Primary Examiner*—Frank W. Lutter
*Assistant Examiner*—Thomas M. Lithgow
*Attorney, Agent, or Firm*—Karl F. Ross; Herbert Dubno

[57] ABSTRACT

A gas-distributing device for use in a gas passage which flares like a diffuser, particularly a passage leading to an electrostatic precipitator, formed by a set of components consisting of perforated sheet metal panels, carrying and connecting elements, in which the carrying elements have no wide end faces extending at right angles to the direction of flow so that the variations of the gas velocity over the entire flow area can be distinctly reduced. Besides, the set of components can be manufactured at lower total costs and the perforated sheet metal panels, which are connected by the connecting element to the carrying elements consisting of flat bar strips, is simplified.

12 Claims, 6 Drawing Figures

GAS DISTRIBUTING DEVICE

FIELD OF THE INVENTION

This invention relates to gas distributing devices for use in gas passage which flare like a diffuser, particularly in electrostatic precipitators and to a set of components for making same, which components consist of perforated sheet metal panels, and carrying and connecting elements.

BACKGROUND OF THE INVENTION

When a gas stream is to be uniformly distributed in a passage which increases in cross-sectional area and in which the diffuser angle exceeds a certain lower limit, it is necessary to install distributing devices. This is particularly necessary in the gas ducts leading to electrostatic precipitators. In such cases, the cross-sectional area may have to be increased in a ratio of up to 1:15. Such gas-distributing devices usually consist of perforated sheet metal panels forming sheet metal walls, in which a large number of surface elements have been punched out and/or lanced to provide a certain ratio of gas flow area to retaining area. The perforated sheet metal panels are arranged to extend substantially at right angles to the gas flow and in passages having a relatively large size are composite. In that case, the individual sheet metal panels are secured by connecting elements to a separate carrying structure.

In a known gas-distributing device, the perforated sheet metal panels are flanged in L-shape on two mutually opposite sides and are flanged in channel-shape on the other two sides, the supporting elements consisting of an I-shaped and channel-shaped rolled section, and only pluggable elements are provided to connect the perforated sheet metal panels and the rolled sections (U.S. Pat. No. 4,207,083).

It has been found that in this known gas-distributing device the velocity of distribution of the cross-section is relatively strongly disturbed by the carrying elements and that this adversely affects the separation performance of the electrostatic precipitator. Particularly when it is necessary to provide a plurality of such gas-distributing devices with their carrying elements in series in the direction of flow, high values of the relative standard deviation S will be obtained. That relative standard deviation S is defined as follows:

$$S = \frac{1}{vm} \sqrt{\frac{\Sigma(vi - vm)^2}{n - 1}} \times 100\%$$

wherein vm = mean gas velocity in the cross-section in which the measurement is performed.

vi = local gas velocity in equal-are elements of the cross-section in which the measurement is performed n = number of elemental areas in which a measurement is performed.

OBJECTS OF THE INVENTION

It is an object of the invention to so improve the gas-distributing device of the type described hereinbefore that the relative standard deviation is distinctly improved so that the requirement for a standard deviation below an upper limit of 25% or even 15% can be met.

Another object is to provide an improved wall assembly such that the assembling is not more expensive than with the known gas-distributing device and that components in a larger number or components which involve greater difficulties in manufacture are not required.

It is also an object to provide a distributor which is also advantageous as regards the assembling expenditure and manufacturing costs.

Another object of this invention is to provide an improved perforated wall structure, especially for the diffuser of an electrostatic precipitator, whereby the disadvantages of earlier arrangements are obviated.

It is also an object of this invention to provide an improved gas distributor or a diffuser assembly incorporating same.

SUMMARY OF THE INVENTION

These objects and others which will become apparent hereinafter are attained, in accordance with the present invention, in a gas-distributing wall, especially for the diffuser of an electrostatic precipitator which comprises a plurality of perforated wall panels comprised of sheet metal and having flanges bent at edges of these panels to be joined together by a connecting carrier so that the flanges form part of an L-section edge portion along each panel. The legs of the Ls, i.e. the flanges, are received in accordance with the present invention, between two flat metal bar strips which are spaced apart by spacers having widths or interbar spacing greater than the combined thicknesses of the flanges and which, in turn, are longitudinally spaced along the carrier formed by these bars. As a consequence, the carrier, event when receiving the flanges, forms an open work which can have a gas throughput per unit area corresponding to the throughput of the adjoining surfaces of the panels whereby a far more uniform flow through the wall of the gas can be obtained. The pressure drop across the wall can also be more uniform.

The panels can be held in place on the carrier by T-shaped connecting elements whose head engages the adjoining panels over the corner at which the flanges are bent therefrom and whose shank is notched to engage over a respective spacer between the bars. The spacers can be rectangular blocks.

Utilizing such systems as compared to the prior art arrangement in which the carrier is unapertured and in otherwise identical configurations, I have been able to obtain a significant reduction in the standard deviation.

The following relative standard deviations were obtained in a model test using different arrangements A to D comprising three perforated sheet metal walls which were arranged one behind the other and had decreasing flow areas of 58, 46 and 40%.

| Arrangement: | A | B | C | D |
|---|---|---|---|---|
| U.S. Pat. No. 4,207,083 | 24.9 | 29.6 | 28.2 | 44.1 |
| According to the invention: | 15.6 | 22.3 | 21.6 | 31.8 |

It is apparent that the standard deviation is distinctly reduced in all arrangements A to D which had been selected. It is emphasized that only criteria which have nothing to do with the inventive concept determined the selection of the various arrangements. In other words, the relative standard deviation can be distinctly improved in all arrangements which differ in other respects. This means that the velocity is more uniform throughout the gas flow area so that the separation is improved under conditions which are not changed in other respects.

BRIEF DESCRIPTION OF THE DRAWING

Further details and advantages will be explained more in detail with reference to the illustrative embodiment shown in the drawing in which.

SPECIFIC DESCRIPTION

Figure 1:
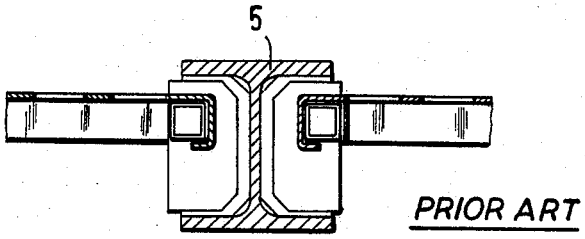
FIG. 1 is a top plan view showing partly in horizontal section a gas-distributing wall in accordance with U.S. Pat. No. 4,207,032.

In the gas-distributing wall shown in FIG. 1 the vertical carrying elements 5 consist of I-sections having end faces which occupy an area of about 8 to 10% of the flow area. Such a restriction of the flow area is not detrimental in itself because the perforated sheet metal panels serve the same purpose and a compensation is possible, if desired, by the use of perforated sheet metal panels having different aperture ratios. A disadvantage resides only in the fact that the carrying elements of the known gas-distributing wall result in flow shadows, which prevent a flow of gas at a uniform velocity throughout the cross-section so that relatively large standard deviations result.

Figure 2:
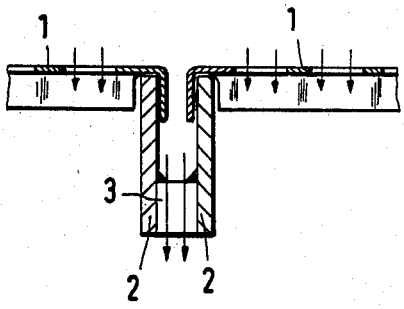
FIG. 2 is a top plan view showing partly in horizontal section a gas-distributing wall in accordance with the invention.

On the other hand, the carrying elements shown in FIG. 2 are "permeable" to the gas flow because the flat bar strips 2 are interconnected only by spaced-apart spacers 3 and the connecting elements 4 (see FIG. 3) obstruct the flow area between the flat bar strips 2 only in a fraction of the total height. The flanged vertical edges of the perforated sheet metal panels 1 are fitted between the flat sections 2 and are secured by means of the connecting elements 4 in a manner which is simpler and less expensive than that adopted in the gas-distributing wall shown in FIG. 1.

Figure 3A:
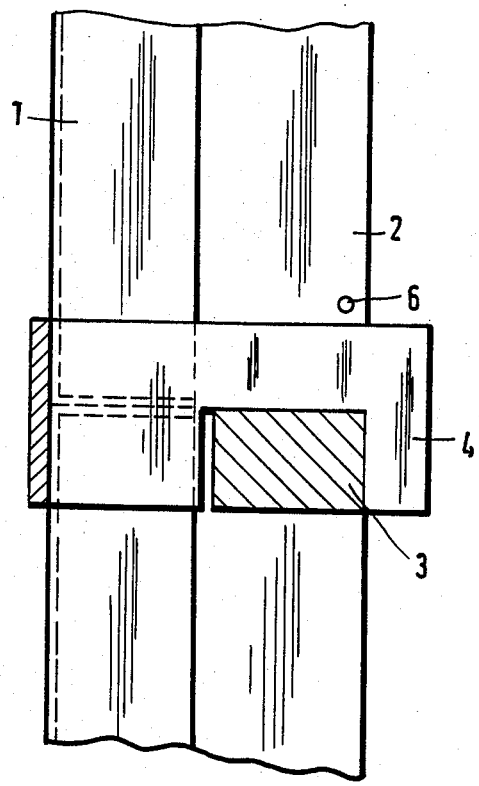
FIG. 3*a* is an enlarged vertical sectional view showing details of the gas-distributing wall in accordance with the invention.
Figure 3B:
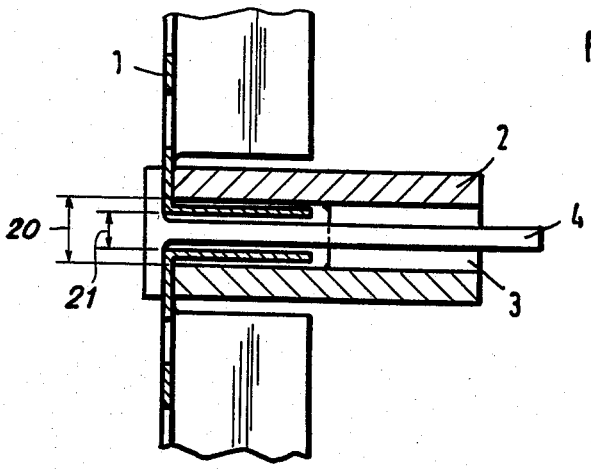
FIG. 3*b* is a top plan view partly in section of the wall of FIG. 3*a;*

FIG. 3*a* is a vertical sectional view and FIG. 3*b* is a horizontal sectional view which show how the perforated sheet metal panels 1 are secured by the connecting elements 4 to the carrying elements consisting of flat section strips 2 and spacers 3. In FIG. 3*a* it is apparent how the mounting means is notched in adaptation to the spacer 3 and receives the latter in the assembly and may be locked in this position by a cotter pin 6, if desired. It will be understood that the connecting elements 4 may be held in position by other means, such as a spot weld. It is particularly apparent from FIG. 3*b* how the perforated sheet metal panels 1 are forced by means of the connecting elements 4 against the flat sections 2 and the flanged edges of the latter are spaced apart. As a result, the perforated sheet metal panels 1 are spatially fixed in the same plane with the flanged edges at right angles thereto. The perforated sheet metal panels are supported in a vertical direction in that they are placed one upon another with their flanged horizontal edges. The interfacial plane is suitably disposed approximately at the center of the vertical extent of the connecting elements 4, as is indicated by a dashed horizontal line in FIG. 3*a*.

Compared with the set known from U.S. Pat. No. 4,207,083, the present set of components for a gas-distributing wall affords the advantage that the gas velocity can be more evenly distributed than the known set as regards manufacturing and assembling expenditures. Besides, the thickness of the flat bar strips 2 (end face) and the spacers and the height and width of the end faces of the connecting elements can be matched in such a manner that the gas-distributing device has between the carrying and connecting elements substantially the same aperture area as the perforated sheet metal panels.

Figure 4:
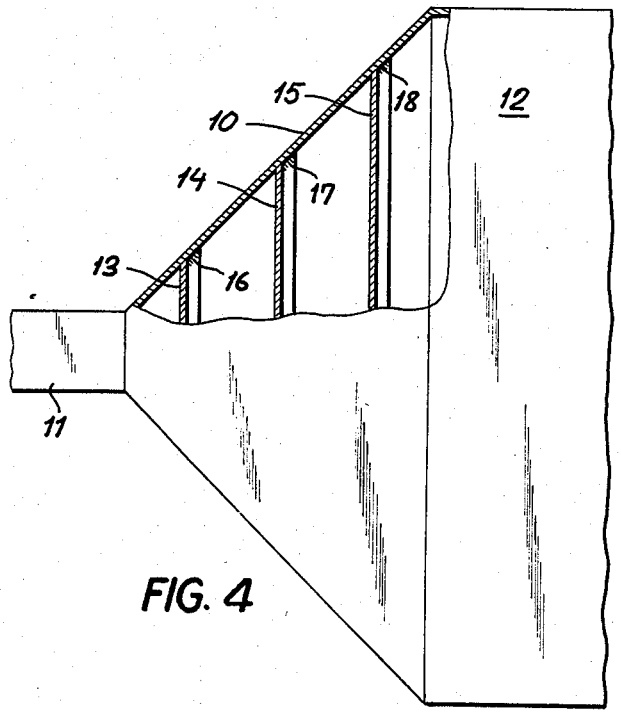
FIG. 4 is a side-elevational view of a diffuser which is provided with the perforated-wall support system of the present invention, showing its relationship to an electrostatic precipitator.

Referring now to FIG. 4, it will be apparent that the perforated walls of the present invention can be provided in a diffuser 10 which flares outwardly from a duct 11 supplying a gas to be cleaned by electrostatic removal of particles therefrom at a significant ratio of the outlet area to the inlet area. The outlet cross-section of the diffuser opens at the upstream side of an electrostatic precipitator 12 and for uniform distribution of the gas flow over the cross-section of this electrostatic precipitator, I provide a number of perforated gas-distributing walls 13, 14 and 15 which may have different ratios of perforation or flow cross-section or obstructive or nonperforated portions of the cross-section.

The carriers for the walls 13, 14 and 15 can be welded at 16, 17 and 18 to the outer diffuser walls or mounted thereon by any convenient means.

Figure 5:
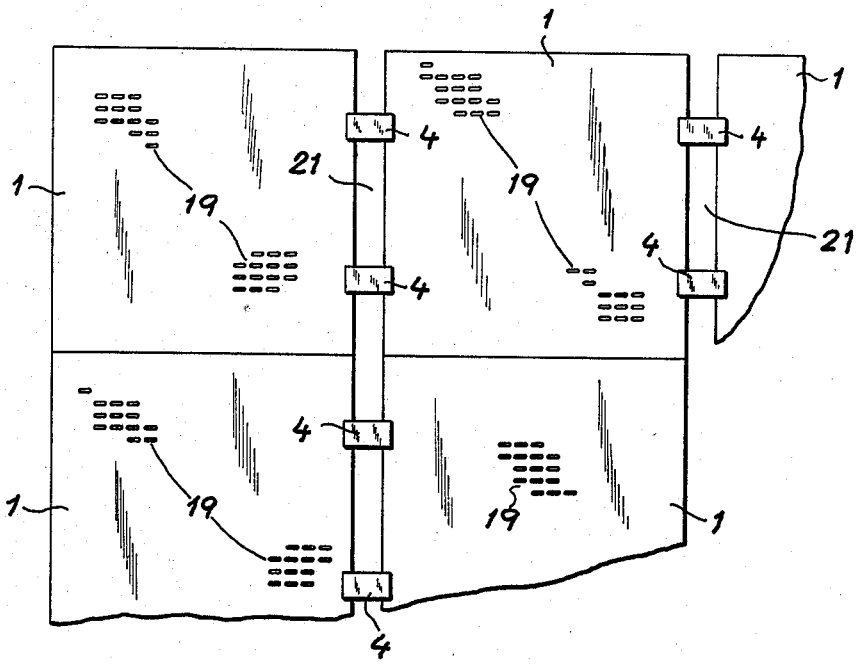
FIG. 5 is a front view of such a gas-distributing wall, partly broken away.

FIG. 5 provides an illustration of a wall of the type described embodying the inventin wherein the panels 1 are seen to have elongated perforations 19 and are held in place by the T-shaped connectors 4. The clearances 20 between the bars 2 and the spacer 3 are reduced when the flanges are inserted and the connecting elements 4 are in place to leave passages 21 in such number and size that the flow cross-section per unit area in the region of the carrier is the same as that of the plates.

I claim:

1. A gas-distributing wall assembly comprising:

at least two perforated sheet metal panels to be joined, said panels having flanges bent along edges of the panels and forming an L-cross-sectional configuration therewith;

a carrier for said panels comprising a pair of mutually parallel bars spaced apart for receiving said flanges, said bars being spaced apart by a plurality of spacers received between said bars, said spacers being spaced apart along said bars; and means for retaining said panels on said bars whereby gas passages are formed between the flanges through said carrier.

2. The gas-distributing wall assembly defined in claim 1 wherein said bars are flat.

3. The gas-distributing wall assembly defined in claim 2 wherein said spacers are rectangular blocks.

4. The gas-distributing wall assembly defined in claim 3 wherein said retaining means includes T-shaped connectors each having a head reaching over adjoining panels and a shank extending between said bars.

5. The gas-distributing wall assembly defined in claim 4 wherein said shank is notched to engage over a respective spacer.

6. The gas-distributing wall assembly defined in claim 5 wherein said passages have a cross-section and distribution such that the gas flow cross-section ratio and nonapertured surface is said carrier is substantially the same as that of said panels.

7. A diffuser for feeding a gas to an electrostatic precipitator, comprising a housing diverging from a gas inlet to an outlet opening into said electrostatic precipitator, and a plurality of wall assemblies disposed in said housing and extending transversely to a direction of gas flow therethrough, each of said wall assemblies comprising:

at least two perforated sheet metal panels to be joined, said panels having flanges bent along edges of the panels and forming an L-cross-sectional configuration therewith;

a carrier for said panels comprising a pair of mutually parallel bars spaced apart for receiving said flanges, said bars being spaced apart by a plurality of spacers received between said bars, said spacers being spaced apart along said bars; and means for retaining said panels on said bars whereby gas passages are formed between the flanges through said carrier.

8. The diffuser defined in claim 7 wherein said bars are flat.

9. The diffuser defined in claim 8 wherein said spacers are rectangular blocks.

10. The diffuser defined in claim 9 wherein said retaining means includes T-shaped connectors each having a head reaching over adjoining panels and a shank extending between said bar.

11. The diffuser defined in claim 10 wherein said shank is notched to engage over a respective spacer.

12. The diffuser defined in claim 11 wherein said passages have a cross-section and distribution such that the gas flow cross-section ratio and nonapertured surface to said carrier is substantially the same as that of said panels.

* * * * *